US008289117B2

(12) United States Patent
Dal Re et al.

(10) Patent No.: US 8,289,117 B2
(45) Date of Patent: Oct. 16, 2012

(54) IGNITION COIL WITH ENERGY STORAGE AND TRANSFORMATION

(75) Inventors: Massimo Augusto Dal Re, Modena (IT); Giuseppe Fulchini, Carpi (IT); Paolo Pignatti, Carpi (IT)

(73) Assignee: Federal-Mogul Corporation, Southfield, MI (US)

( * ) Notice: Subject to any disclaimer, the term of this patent is extended or adjusted under 35 U.S.C. 154(b) by 57 days.

(21) Appl. No.: 12/816,035

(22) Filed: Jun. 15, 2010

(65) Prior Publication Data

US 2011/0304419 A1 Dec. 15, 2011

(51) Int. Cl.

| | |
|---|---|
| ***H01F 21/00*** | (2006.01) |
| ***H01F 17/06*** | (2006.01) |
| ***H01F 27/02*** | (2006.01) |
| ***H01F 38/12*** | (2006.01) |
| ***H01F 7/06*** | (2006.01) |
| ***H01F 7/00*** | (2006.01) |
| ***F02P 3/02*** | (2006.01) |

(52) U.S. Cl. ..... 336/110; 336/178; 336/90; 123/634; 123/635; 29/606; 29/602.1; 335/229

(58) Field of Classification Search ..... 336/90, 336/92, 96, 178, 234, 212, 110; 123/634–635; 331/110

See application file for complete search history.

(56) References Cited

U.S. PATENT DOCUMENTS

| | | | | |
|---|---|---|---|---|
| 3,209,295 | A | 9/1965 | Baermann | |
| 3,359,459 | A | 12/1967 | Smith | |
| 3,500,086 | A | 3/1970 | Baermann | |
| 3,639,788 | A | 2/1972 | Horan | |
| 4,402,036 | A | 8/1983 | Hensley et al. | |
| 4,546,753 | A * | 10/1985 | Pierret | 123/634 |
| 4,990,881 | A * | 2/1991 | Ooyabu | 336/110 |
| 5,429,103 | A | 7/1995 | Rich | |
| 5,685,065 | A * | 11/1997 | Suzuki et al. | 29/606 |
| 5,815,062 | A * | 9/1998 | Koyuhara et al. | 336/233 |
| 5,821,844 | A * | 10/1998 | Tominaga et al. | 336/110 |
| 7,212,092 | B2 | 5/2007 | Nuebel et al. | |
| 2005/0279300 | A1 * | 12/2005 | Liang et al. | 123/90.11 |
| 2007/0008741 | A1 | 1/2007 | Al-Khayat et al. | |
| 2009/0244802 | A1 | 10/2009 | Takeuchi et al. | |
| 2010/0271157 | A1 * | 10/2010 | Talon | 335/229 |

FOREIGN PATENT DOCUMENTS

| | | | |
|---|---|---|---|
| EP | 0 034 955 | A1 | 9/1981 |
| WO | WO 2006097870 | A2 | 9/2006 |

* cited by examiner

*Primary Examiner* — Mohamad Musleh
*Assistant Examiner* — Mangtin Lian
(74) *Attorney, Agent, or Firm* — Robert L. Stearns; Dickinson Wright, PLLC

(57) ABSTRACT

This invention is directed to a device for energy storage and transformation that allows an increased level of energy storable in an ignition coil, using a coil that has a permanent magnet inside of a primary magnetic core, with a second magnetic core that closes the magnetic path of the primary magnetic core.

13 Claims, 2 Drawing Sheets

IGNITION COIL WITH ENERGY STORAGE AND TRANSFORMATION

TECHNICAL FIELD OF THE INVENTION

This invention relates to a device and method for energy storage and energy transformation.

BACKGROUND OF THE INVENTION

Devices for energy storage and energy transformation are known in the practice in particular as ignition coils, which represent an energy-transmitting high-voltage source and in engines operating according to the spark ignition principle, are used to activate a spark plug, which in turn ignites the fuel mixture in the combustion chamber of the internal combustion engine. In such an energy storage device and transformer embodied as an ignition coil, comparatively low supply voltage electrical energy, normally from a direct current vehicle electrical system, is converted into high-voltage electrical energy at a desired point in time at which an ignition pulse is to be delivered to the spark plug.

To convert electrical energy into magnetic energy, the system current of the motor vehicle flows through a first coil, which is customarily a copper wire winding, as a result of which a magnetic field forms around this coil, the magnetic field having a specific direction and being a closed-line magnetic field. To deliver the stored electrical energy in the form of high-voltage pulses, the previously built-up magnetic field is forced to change its direction by cutting off the electric current, causing an electrical high voltage to be formed in a second coil, which is located physically close to the first coil and has a much higher number of turns. The conversion of the now electrical energy at the spark plug causes the previously built-up magnetic field to break down and the ignition coil to discharge. The design of the second winding makes it possible to set high voltage, spark current and spark duration in the ignition of the internal combustion engine as needed.

All ignition coils have an I core made of a ferromagnetic material such as iron, for example. The I core is thus a rod-shaped or rectangular iron core, the cross-section of which may be made up of lamellae of soft iron sheet. In the known related art, the placement of the coils and of the I core is subject to great variation; however, the coils are usually superposed radially and are positioned concentrically to the I core. It is also customary in practice to provide, in addition to an I core of this type, a peripheral core made of ferromagnetic material, which surrounds the longitudinal extent of the coils and is also described as an "O core" or "ferromagnetic circuit." In order to reduce losses when building up and breaking down the magnetic field, this peripheral core is also normally a combination of layered iron lamellae.

In order to be able to install the windings or coils, the I core and the peripheral core of a ferromagnetic circuit may not be of one piece but instead must be assembled from different component parts. A typical configuration is the construction of an I core and an O core forming a closed O, the I core together with the windings surrounding it being inserted into the interior of the O core at the time the ignition coil is assembled so that the lamella stacks of the cores lie in one plane when installed.

In order to influence the magnetic field in a specific way, the ferromagnetic circuit is normally interrupted by spaces or air gaps, this being referred to as a "magnetic shear." A permanent magnet may also be located in such a space, making a further increase in the magnetic energy possible under specific conditions. The system of such air gaps and permanent magnets is preferably located at the joints between the I core and the O core.

A problem with the known devices for energy storage and energy transformation designed as ignition coils is that assembly gaps which are based on the manufacturing tolerances and the insertion play for inserting the I core into the O core must be maintained in the design of the magnetically active core elements. These gaps may be incompatible with the gap dimensions desired based on energy considerations.

Thus, for example, when a permanent magnet is positioned at one end area of the I core between the I core and the O core, no air gap is desired between the permanent magnet and the O core. The air gap that must be provided for manufacturing reasons must be compensated by appropriate measures or derivative actions, which are reflected in the overall dimensions and ultimately in additional costs as well.

U.S. Pat. No. 7,212,092 to Bosch discloses a device for energy storage and transformation that overcomes some of the problems addressed above. Referring to FIG. 1, a compact ignition coil has a centrally positioned magnetically soft I-core. A first coil former 2 is positioned concentrically surrounding the magnetically active I core, a winding connected to a supply voltage from a vehicle electrical system and used as a primary winding being applied to coil former 2. Situated radially within the first coil former 2 is a second internal coil former 3, which surrounds the I core and has a winding used as a secondary winding connected to a high-voltage terminal connected to a spark plug. In an end area, the I core 1 is situated within coil formers 2 and 3 and has a permanent magnet 4. The I core, with coil formers 2 and 3, is inserted into a through recess in peripheral core 5. An assembly gap 6 that compensates for manufacturing tolerances is situated between permanent magnet 4 and peripheral core 5. The gap 6 may be closed by the force of permanent magnet 4 in various embodiments. In this device, the permanent magnet is accommodated between two separate parts of the magnetic core. In this configuration, it is possible to achieve higher energy from the coil due to the non-linearity of the primary current versus time only when the magnetic area is realized on the I core with zero gaps at all interfaces between the primary and secondary coils.

SUMMARY OF THE INVENTION

This invention is directed to a device for energy storage and transformation that allows an increased level of energy storable in an ignition coil, using a coil that has a permanent magnet inside of a primary magnetic core, with a second magnetic core that closes the magnetic path of the primary magnetic core.

In one embodiment of the invention, there is a device for energy storage and energy transformation, including a primary magnetic core with an enlarged section for storing energy; a secondary magnetic core forming a magnetic path with the primary magnetic core, wherein a gap is formed between each end of the secondary magnetic core and respective ends of the primary magnetic core; and a permanent magnet received in the primary magnetic core.

In another embodiment of the invention, there is a device for energy storage and transformation in an ignition coil, including a coil that has a permanent magnet received in a primary magnetic core, and a second magnetic core that closes a magnetic path of the primary magnetic core.

In still another embodiment of the invention, there is a method for storing and transforming energy, including receiving a permanent magnet in a primary magnetic core;

forming a magnetic path using a secondary magnetic core with the primary magnetic core, wherein a gap is formed between each end of the secondary magnetic core and respective ends of the primary magnetic core; and storing energy in an enlarged area of the primary magnetic core.

In one aspect of the invention, the enlarged area includes two saturation sections which store energy during coil charging.

In another aspect of the invention, the saturation sections are defined by a distance from the permanent magnet to an inner edge of the primary magnetic core.

In still another aspect of the invention, the primary magnetic core is shaped substantially as an E.

In yet another aspect of the invention, the secondary magnetic core is shaped substantially as an I.

In one aspect of the invention, the device is an ignition coil of an ignition system of a motor vehicle.

These and other features and advantages of this invention will become more apparent to those skilled in the art from the detailed description of a preferred embodiment. The drawings that accompany the detailed description are described below.

DETAILED DESCRIPTION OF THE INVENTION

This invention is directed to a device for energy storage and transformation that allows an increased level of energy storable in an ignition coil, using a coil that has a permanent magnet inside of a primary magnetic core, with a second magnetic core that closes the magnetic path of the primary magnetic core.

Advantageously, with an arrangement in accordance with the invention, an increased level of storable energy may be realized in an ignition coil having specific geometrical dimensions of the magnetic core, which dimensions are typically driven by the room or size identified on the engine to allocate the respective ignition coil. As a result, engine sizes may be downsized, along with reduced energy consumption and lower emissions.

Figure 3:
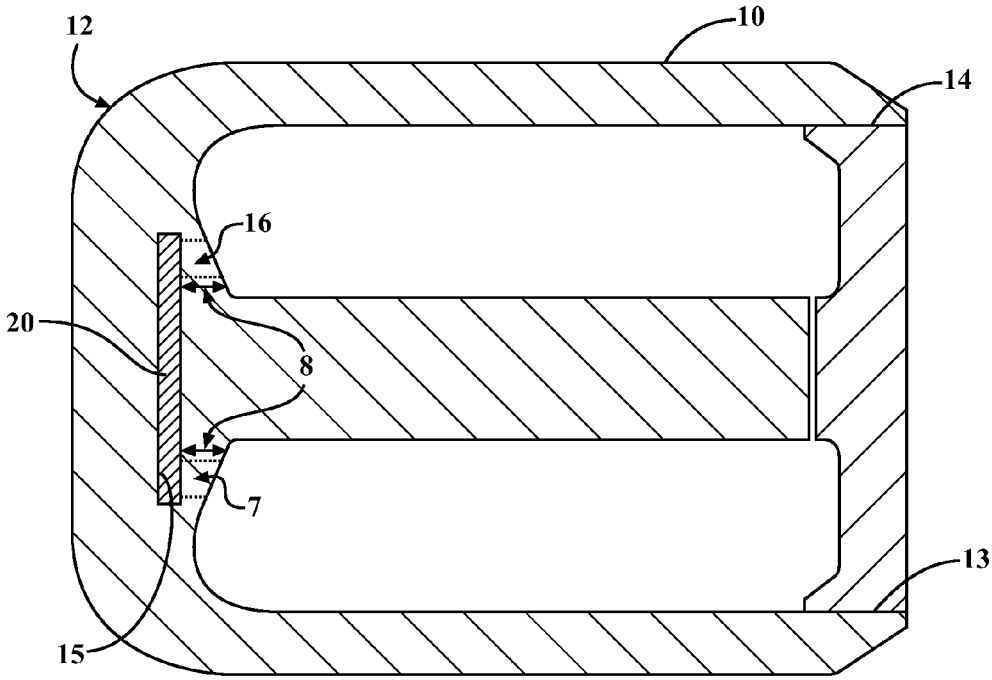
FIG. 3 shows an assembled longitudinal section through a system of coils and core elements in accordance with FIG. 2.

This invention provides higher storage energy capability in a given space for an ignition coil for an internal combustion engine. Referring to FIG. 3, this higher storage capability is realized, thereby inducing a local magnetic short circuit in the areas 16 and 7. The remaining iron around the magnet derives a portion of the magnetic flux created by magnet to the external regions of the E-core type that are therefore not saturated. Performances in storage energy capability are highly influenced by the equilibrium of the iron core saturation levels in areas 16 and 7 and in the external regions of E-core. The saturation of iron core areas 16 and 7 increases the initial slope of the primary current. This initial slope can be modified with dimensions of areas 16 and 7, dimensions of slot 15 and energy grade of the permanent magnet. When the primary coil is excited, it creates a magnetic flux in a direction opposite of the magnetic one. When primary current flowing in the primary circuit reaches a value for which the magnetic flux take out from saturation the local areas 16 and 7, the primary current gets again is linear behavior until the required final current value. The storage energy is then increased compared to a coil where primary current has always a linear behavior.

Figure 2:
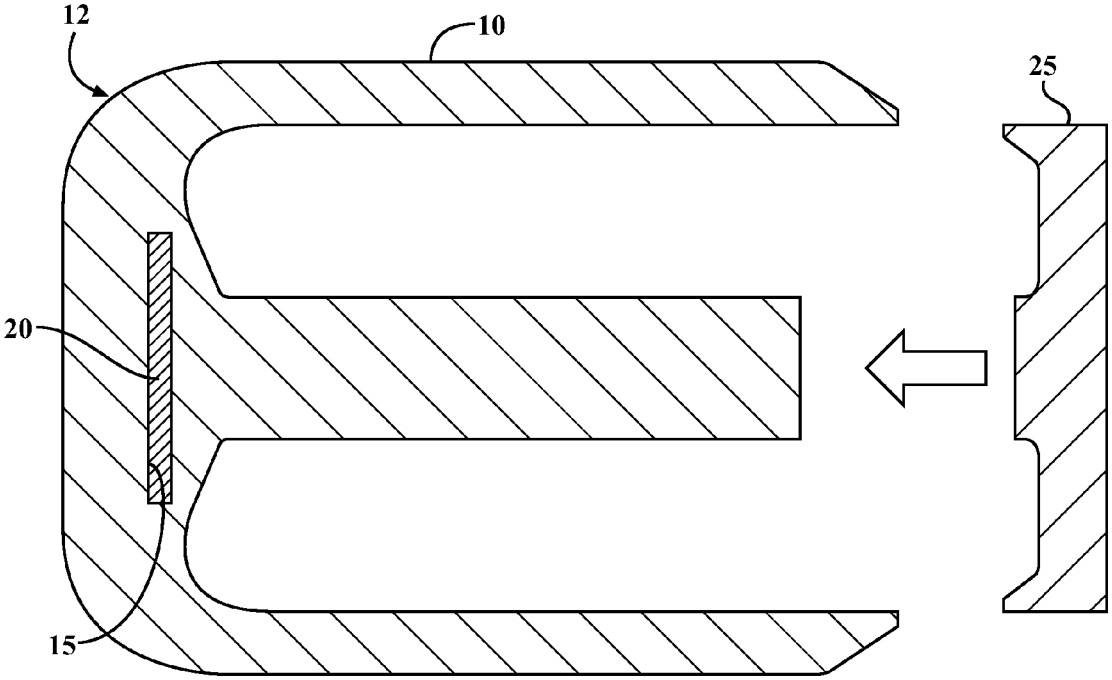
FIG. 2 shows a pre-assembled longitudinal section through a system of coils and core elements in accordance with an embodiment of the invention.

FIG. 2 shows a pre-assembled longitudinal section through a system of coils and core elements in accordance with an embodiment of the invention. The ignition coil 12 includes a primary magnetic core 10 (E-core) and a secondary magnetic core 25 (I-core). The primary core 10 has an E-shape with a slot 15 which is shaped to receive a permanent magnet 20. The secondary magnetic core 25 is I-shaped and completes or closes the loop in the primary magnetic core 10 when in the assembled state (FIG. 3).

FIG. 3 shows an assembled longitudinal section through a system of coils and core elements in accordance with FIG. 2. The primary magnetic core 10 and secondary magnetic core 25 in the assembled state together form a peripheral magnetic core, where air gaps 13 and 14 are formed at interfaces of primary and secondary cores. Saturation areas 16 and 7 act to store energy during coil charging, and distance 8 is the distance between the permanent magnet 15 and the lamination edge of the primary magnetic core 10.

Figure 1:
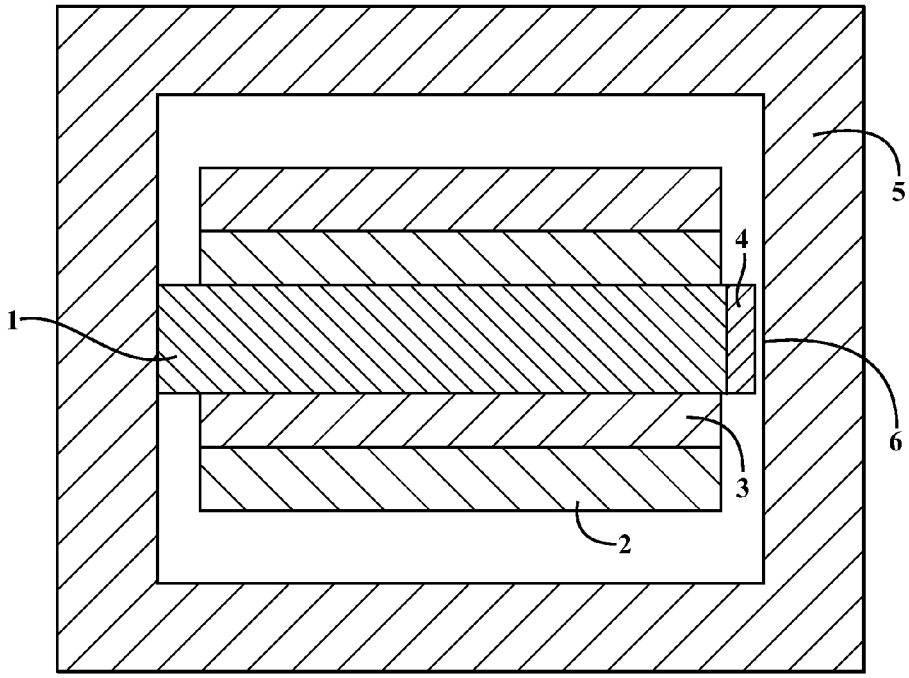
FIG. 1 PRIOR ART
FIG. 1 shows a schematic longitudinal section through as system of coils and core elements of a known compact ignition coil.
Figure 4:
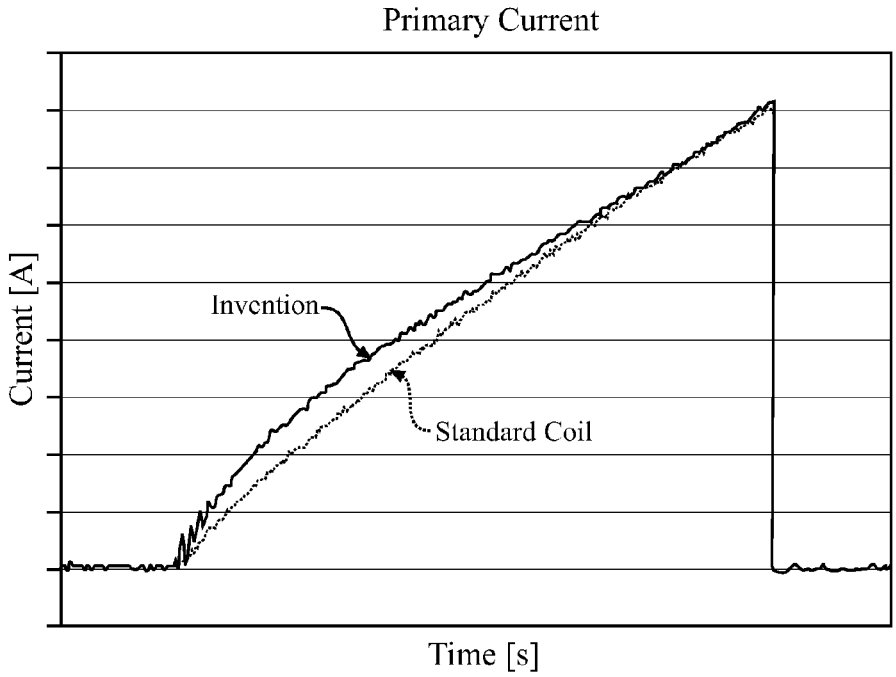
FIG. 4 shows the graphs of primary current in the case of standard coil, in accordance with FIG. 1, and case of invention in accordance with FIG. 2.

According to this aspect of the invention, the permanent magnet is located inside the magnetic core in order to increase energy performance (energy levels) and to avoid magnetic saturation of the core material during normal operating conditions of the engine. In a standard coil, on the other hand, in which a permanent magnet is allocated between two separate parts of the magnetic core, a variation of current flowing in the primary winding with respect to time is nearly linear, as shown in FIG. 4. In the exemplary embodiment of the present invention, the variation of current flowing in the primary winding with respect to time is nearly non-linear in the first part of the curve. Due to the fact that, with all other parameters unchanged, energy stored in the coil is proportional to the area enclosed by the curve of current flowing in the primary winding with respect to time, the result is that energy stored in the coil of the exemplary embodiment of the present invention is higher than the standard embodiment. The non-linear behavior of the current curve versus time is realized with a primary inductance variable during the charging period of the primary winding. Inductance is low at the beginning of the charging period and increases to a constant value until the need of the charging period.

Referring to FIGS. 2 and 3, a more detailed explanation of the invention in accordance with one embodiment is described. The invention includes, for example, a magnetic core component 10 having an E-shape, in a preferred embodiment, and an enlarged section with a slot 15 to receive and hold a permanent magnet 20; a permanent magnet 20; and a magnetic core 25 having an I-shape, in a preferred embodiment, to close the magnetic path of magnetic core component 10. It is readily understood that the magnetic core components may be formed in various shapes and sizes. Other possible magnetic cores include components having two E-shaped components with the slot 15 with the enlarged area to be located in one or both of the E-shaped cores.

Magnetic core component 25 accommodates two end sides of the magnetic core component 10 with air gaps 13 and 14, which parts are reduced to the minimum allowed by cutting process tolerances, but not at zero in the preferred embodiment. The distance 8 and geometry of the enlarged area (the magnetic core area between 16 and 7) of the magnetic core component 10 enable the coil to operate at optimal efficiency.

For these features, the dimensions of slot 15, the distance 8 and the size of the enlarged area between 16 and 7 are significant in this respect. In operation, the small areas 16 and 7 of magnetic core component 10 below permanent magnet 20 are magnetically saturated by the magnetic field generated by the permanent magnet 20 and then operate as air gaps during the beginning of coil primary charging. During coil charging, the magnetic field generated by the primary winding (opposite of that generated by the permanent magnet) takes out from magnetic saturation areas 16 and 7, which become available for energy storage (reversible process). Higher non-linearity of the primary current curve versus time may be obtained with a smaller distance between the permanent magnet and lamination edge (distance 8). An alternative solution to forming small areas, not magnetized below the permanent magnet 20, is to locally stress the material until ferromagnetic properties are lost (irreversible process). Localized stress on the material can be performed by thermal or mechanical processes as understood by the skilled artisan.

This aspect of the present invention therefore allows higher energy stored in the coil by means of the non-linearity of the curve of the primary current versus time, without the constraint of requiring zero gaps at the interface of the primary and second coils.

The foregoing invention has been described in accordance with the relevant legal standards, thus the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

We claim:

1. A device for energy storage and energy transformation, comprising:

a primary magnetic core with an enlarged section for storing energy;

a secondary magnetic core forming a magnetic path with the primary magnetic core, wherein a gap is formed between each end of the secondary magnetic core and respective ends of the primary magnetic core; and a permanent magnet received in the primary magnetic core, and wherein the enlarged section of the primary magnetic core includes two saturation sections which store energy during coil charging and are defined by a distance from the permanent magnet to an inner edge of the primary magnetic core.

2. The device according to claim 1, wherein the primary magnetic core is shaped substantially as an E.

3. The device according to claim 1, wherein the secondary magnetic core is shaped substantially as an I.

4. The device according to claim 1, wherein the device is an ignition coil of an ignition system of a motor vehicle.

5. A device for energy storage and transformation in an ignition coil, comprising:

a coil that has a permanent magnet received in a primary magnetic core, the primary magnetic core including an enlarged section for storing energy; and a second magnetic core that closes a magnetic path of the primary magnetic core, and wherein the enlarged section of the primary magnetic core includes two saturation sections which store energy during coil charging and are defined by a distance from the permanent magnet to an inner edge of the primary magnetic core.

6. The device according to claim 5, wherein the second magnetic core forms a magnetic path with the primary magnetic core, and a gap is formed between each end of the secondary magnetic core and respective ends of the primary magnetic core.

7. The device according to claim 5, wherein the primary magnetic core is shaped substantially as an E.

8. The device according to claim 5, wherein the secondary magnetic core is shaped substantially as an I.

9. The device according to claim 5, wherein the device is an ignition coil of an ignition system of a motor vehicle.

10. A method for storing and transforming energy, comprising:

receiving a permanent magnet in a primary magnetic core;

forming a magnetic path using a secondary magnetic core with the primary magnetic core, wherein a gap is formed between each end of the secondary magnetic core and respective ends of the primary magnetic core; and storing energy in an enlarged area of the primary magnetic core, wherein the enlarged area includes two saturations which store the energy during coil charging and are defined by a distance from the permanent magnet to an inner edge of the primary magnetic core.

11. The method according to claim 10, wherein the primary magnetic core is shaped substantially as an E.

12. The method according to claim 10, wherein the secondary magnetic core is shaped substantially as an I.

13. The method according to claim 10, wherein the device is an ignition coil of an ignition system of a motor vehicle.

* * * * *